United States Patent [19]

Wied, deceased

[11] Patent Number: 4,586,777

[45] Date of Patent: May 6, 1986

[54] BATTERY-SWITCH MODULE ADAPTER

[75] Inventor: Julius P. Wied, deceased, late of Hudson, Ohio, by Forrest S. Dean, administrator

[73] Assignee: Lucerne Products, Inc., Hudson, Ohio

[21] Appl. No.: 631,345

[22] Filed: Jul. 16, 1984

[51] Int. Cl.[4] ..... H01R 13/50

[52] U.S. Cl. ..... 339/154 A; 339/91 R; 339/256 R; 339/258 R

[58] Field of Search ..... 339/154, 155, 156, 164, 339/166, 168, 170, 91 R, 76, 89 R

[56] References Cited

U.S. PATENT DOCUMENTS

| | | | |
|---|---|---|---|
| 1,635,507 | 7/1927 | Seasock | 339/76 |
| 1,977,106 | 10/1934 | Wylie | 339/89 R |
| 2,613,245 | 10/1952 | Brouillette | 339/154 R |
| 2,687,515 | 8/1954 | Booth | 339/154 A |
| 2,925,592 | 2/1960 | Noyes | 339/91 R |
| 3,092,698 | 6/1963 | Brenneman | 339/166 R |
| 3,869,191 | 3/1975 | Zolnar, Jr. et al. | 339/91 R |

FOREIGN PATENT DOCUMENTS

| | | | |
|---|---|---|---|
| 3203809 | 8/1983 | Fed. Rep. of Germany | 339/154 A |
| 319201 | 7/1935 | Italy | 339/170 |

*Primary Examiner*—Gil Weidenfeld
*Assistant Examiner*—David L. Pirlot
*Attorney, Agent, or Firm*—Baldwin, Egan & Fetzer

[57] ABSTRACT

An integral electrical switch adapter for mechanically and electrically connecting a battery to a switch module without wires or soldered connections. The adapter includes a generally planar base having a first pair of flexible upstanding spaced attachment arms at the sides of the base for detachably securing the adapter to an associated electrical switch speed control module. The base also has a second pair of flexible downwardly extending spaced electrically conducting attachment arms at the sides of the base for electrically and mechanically securing the adapter to leads on an associated battery in detachable relationship therewith. The base also has a pair of upstanding elongated electrical switch bayonnet-type prong connectors on the front of the base and electrically connected, respectively, to the second pair of attachment arms for detachable electrical connection to associated leads on the module, thereby mechanically and electrically connecting the battery to the module.

9 Claims, 6 Drawing Figures

BATTERY-SWITCH MODULE ADAPTER

This invention relates to an adapter for connecting a battery to a switch module in a portable electric motor-driven tool and more particularly to such an adapter that is free of lead wires and soldered connections.

BACKGROUND OF THE INVENTION

Recent types of portable electric motor driven tools contain a power pack or battery. The connections between the battery and the tool switch are usually effected with wires and soldered connections.

However, lead wires and soldered connections are costly and troublesome. The wires always seem to be getting in the way of something. A badly soldered connection builds up heat resulting in a poor contact or, eventually, an open circuit.

Therefore, it is an object of the invention to provide an adapter for connecting a hand tool switch to a battery that is free of wires and soldered connections.

A further object of the invention is to provide an adapter of the above type that is simple in construction, inexpensive to manufacture, and highly effective in operation.

BRIEF DESCRIPTION OF THE INVENTION

Briefly the foregoing objects are accomplished by the provision of an integral electrical switch adapter for mechanically and electrically connecting a battery to a switch module without wires or soldered connections. The adapter includes a generally planar base having a first pair of flexible upstanding spaced attachment arms at the sides of the base for detachably securing the adapter to an associated electrical switch speed control module. The base also has a second pair of flexible downwardly extending spaced electrically conducting attachment arms at the sides of the base for electrically and mechanically securing the adapter to leads on an associated battery in detachable relationship therewith. The base also has a pair of upstanding elongated electrical switch bayonnet type prong connectors on the front of the base and electrically connected by rivets, respectively, to the second pair of attachment arms for detachable electrical connection to associated leads on the module, thereby mechanically and electrically connecting the battery to the module. The outer ends of the second pair of attachment arms are flared outwardly to facilitate attachment of the adapter to the associated battery.

Each of the first pair of attachment arms has an inverted U-shape configuration, with the ends of the legs of the U-shape being secured to said base. The cross-portion of each such U-shaped attachment arm has an outwardly extending pocket for receiving a tool therein to flex the arm outwardly enabling facile removal of the adapter from the module.

The base of the adapter has a transverse groove and the second pair of attachment arms are secured in such groove to prevent such attachment arms from rotating in a horizontal plane on the base. Also, the base has a pair of longitudinal grooves and the pair of prong connectors are secured respectively in such longitudinal grooves to prevent them from rotating in a horizontal plane on the base.

Other objects and advantages of the invention will be apparent from the following description taken in conjunction with the drawings wherein:

BRIEF DESCRIPTION OF THE DRAWINGS

In the drawings, like numbers and letters are used to identify like and similar parts throughout the several views.

Figure 3:
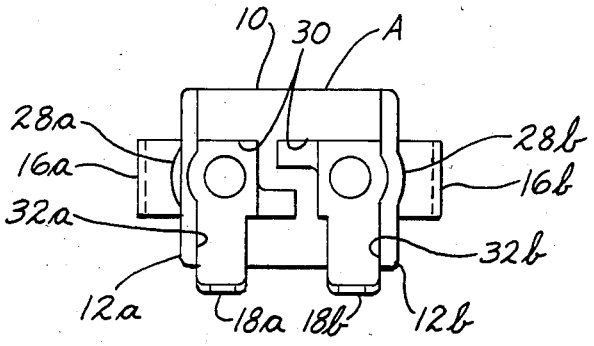
FIG. 3 is a top plan view of the adapter shown in FIG. 1.

Referring to the drawings, there is shown an adapter A, constructed in accordance with the invention, and including a generally planar base 10 having a first pair of flexible upstanding spaced attachment arms **12*a*, 12*b*, at the sides 14*a*, 14*b*, respectively, of the base for detachably securing the adapter to an associated electrical switch speed control module M. The base 10 also has a second pair of flexible downwardly extending spaced electrically conducting attachment arms 16*a*, 16*b*, at the sides 14*a*, 14*b*, respectively, of the base for electrically and mechanically securing the adapter A to leads (not) shown) on an associated battery B, in detachable relationship therewith, the battery being gripped between the opposing arms 16*a*, 16*b*. The base also has a pair of upstanding elongated electrical switch bayonnet-type prong connectors 18*a*, 18*b*, on the front of the base, such connectors being electrically connected, respectively, to the second pair of attachment arms 16*a*, 16*b*, for detachable electrical connection to associated leads (not shown) on the module M, thereby mechanically and electrically connecting the battery to the module. The prong connectors 18*a*, 18*b*, are preferably connected to the arms 16*a*, 16*b*, by means of rivets such as, for example, the rivet 20 (FIG. 1) which connects the arm 16*a* with the prong connector 18*a***.

Figure 1:
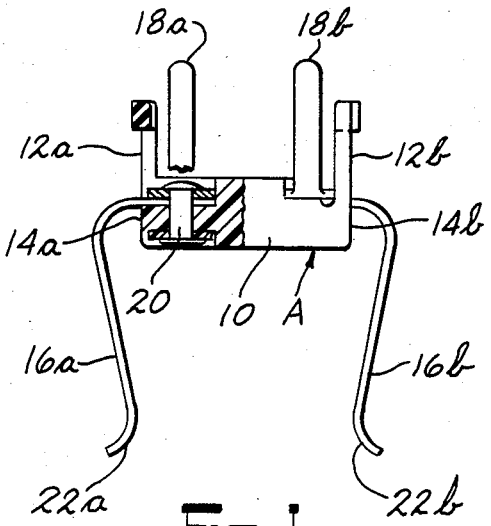
FIG. 1 is a front elevational view of an adapter constructed in accordance with the invention.

As best shown in FIG. 1, the outer ends **22*a*, 22*b*, of said second pair of attachment arms 16*a*, 16*b***, are flared outwardly to facilitate attachment of the adapter to the battery.

Figure 2:
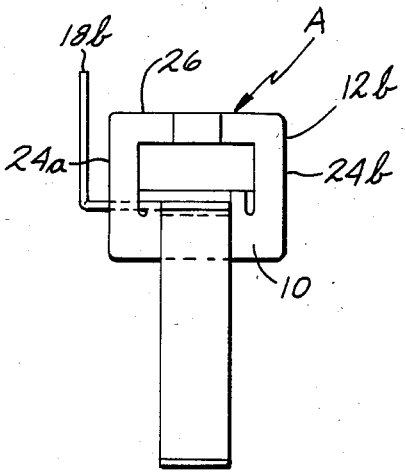
FIG. 2 is a right side view of the adapter shown in FIG. 1.
Figure 6:
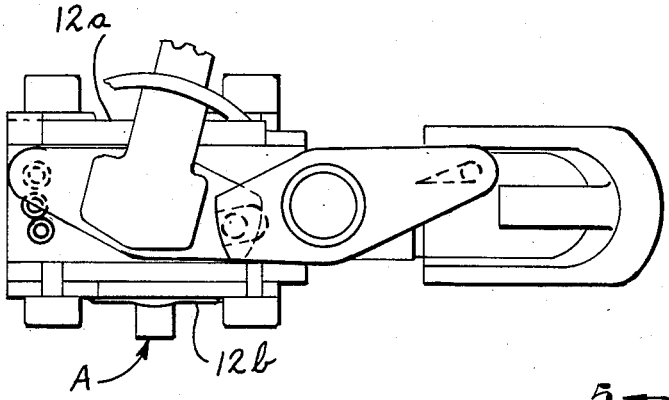
FIG. 6 is a top plan view of the switch shown in FIG. 4.
Figure 4:
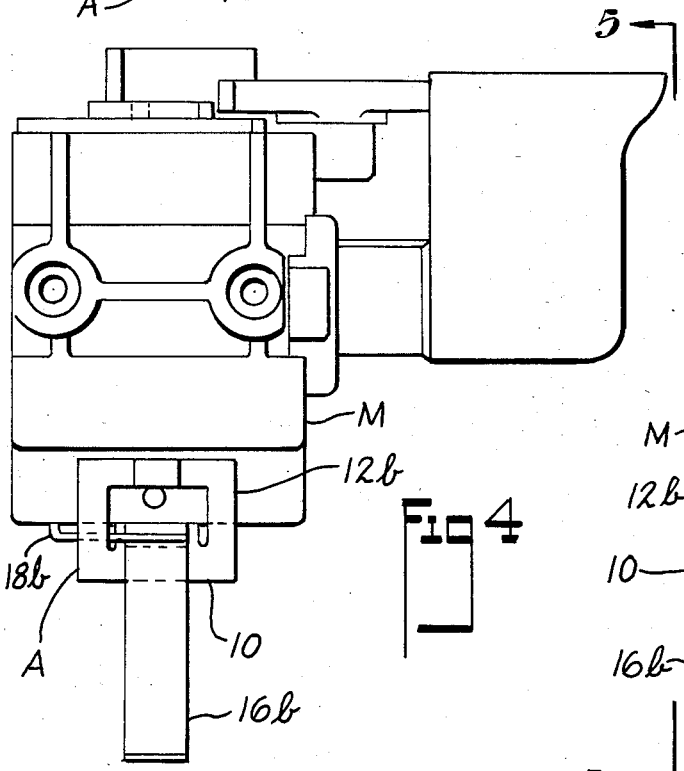
FIG. 4 is a side elevational view of a portable electric motor-driven tool trigger switch and showing the adapter of FIG. 1 secured therein in operative position.
Figure 5:
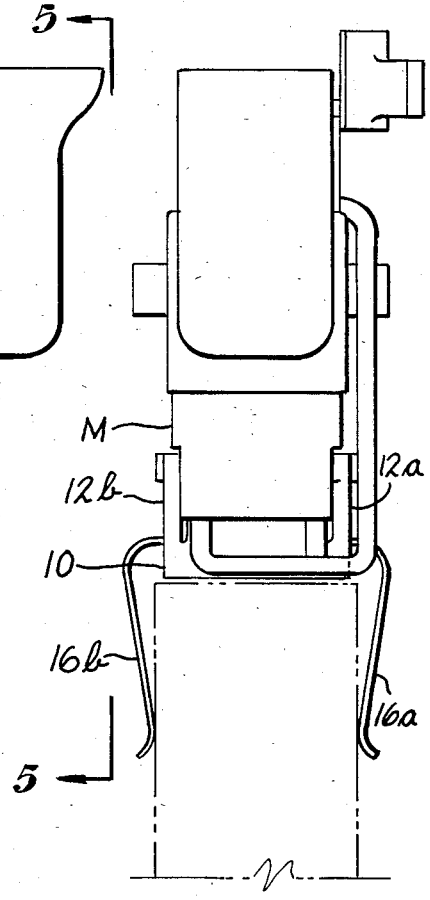
FIG. 5 is a view taken along the line 5—5 of FIG. 4 and showing the adapter detachably secured to a battery shown in dot-dash lines.

It is to be noted that each of the first pair of attachment arms **12*a*, 12*b*, has an inverted U-shape configuration with the ends of the legs of the U-shape being secured to said base. More specifically, and as best shown in FIG. 2, arm 12*b* is of inverted U-shape having the legs 24*a*, 24*b*, and the base 26 of such U-shape. Also, the cross-portion or base of each such U-shape attachment arms(s) has an outwardly extending pocket(s) 28*a*, 28*b*, (FIG. 3**) for receiving a tool therein to flex the arm outwardly enabling facile removal of the adapter from the module.

Also, it is to be noted that the base 10 has a transverse groove 30 (FIG. 3) and the second pair of attachment arms **16*a*, 16*b*, are secured in such groove 30 to prevent the attachment arms 16*a*, 16*b*, from rotating in a horizontal plane on the base 10**.

Additionally, the base 10 has a pair of longitudinal grooves **32*a*, 32*b*, (FIG. 3) and the pair of prong connectors 18*a*, 18*b*, are secured, respectively, in such longitudinal grooves 32a, 32b, to prevent them from rotating in a horizontal plane on the base 10**.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

I claim:

1. An integral electrical switch adapter for mechanically and electrically connecting a battery to a switch module comprising; a base having means for detachably securing the adapter to an associated electrical switch speed control module, said base also having downwardly extending from said base in a direction opposite to said detachable securing means a pair of spaced electrically conducting flexible attachment arms for grasping an associated battery therebetween and thus detachably securing the adapter to leads on the battery, said base also having a pair of elongated electrical switch bayonnet-type prong connectors extending from the base in the same direction as said detachable securing means electrically connected respectively to said pair of attachment arms for detachable electrical connection to associated leads on the module, thereby mechanically and electrically connecting the battery to the module.

2. An integral electrical switch adapter for mechanically and electrically connecting a battery to a switch module comprising; a generally planar base having opposed sides, a first pair of flexible upstanding spaced attachment arms at the sides of the base for detachably securing the adapter to an associated electrical switch speed control module, said base also having a second pair of flexible downwardly extending spaced electrically conducting attachment arms connected at one end thereof to the sides of the base, grasping an associated battery therebetween an thus electrically and mechanically securing the adapter to leads on the battery in detachable relationship therewith, said base also having a pair of upstanding elongated electrical switch bayonnet-type prong connectors on the front of the base and electrically connected respectively to said second pair of attachment arms for detachable electrical connection to associated leads on the module, thereby mechanically and electrically connecting the battery to the module.

3. The structure of claim 2 wherein each of the second pair of attachment arms has a free end that is flared outwardly to facilitate attachment of the adapter to the associated battery.

4. The structure of claim 2 wherein said second pair of attachment arms and said pair of prong connectors are secured together respectively by rivets.

5. The structure of claim 2 wherein said base has a transverse groove and said second pair of attachment arms are secured in said groove to prevent such attachment arms from rotating in a horizontal plane on the base.

6. The structure of claim 2 wherein said base has a pair of longitudinal grooves and said pair of prong connectors are secured respectively in said longitudinal grooves to prevent them from rotating in a horizontal plane on the base.

7. The structure of claim 2 wherein each of said first pair of attachment arms has an inverted U-shape configuration with the ends of the legs of the U-shape being secured to said base.

8. The structure of claim 7 wherein each U-shaped attachment arm has an outwardly extending pocket for receiving a tool therein to flex the arm outwardly enabling facile removal of the adapter from the module.

9. An integral electrical switch adapter for mechanically and electrically connecting a battery to a switch module comprising; a generally planar base of generally rectangular shape having a front, back and opposed sides, a first pair of flexible upstanding spaced attachment arms at the opposed sides of the base for detachably securing the adapter to an associated electrical switch speed control module, said base also having a second pair of flexible downwardly extending spaced electrically conducting attachment arms at the sides of the base grasping an associated battery therebetween and thus for electrically and mechanically securing the adapter to leads on the battery in detachable relationship therewith, said base also having a pair of upstanding elongated electrical switch bayonnet-type prong connectors on the front of the base and electrically connected by rivets respectively to said second pair of attachment arms for detachable electrical connection to associated leads on the module, thereby mechanically and electrically connecting the battery to the module, the outer ends of said second pair of attachment arms being flared outwardly to facilitate attachment of the adapter to the associated battery, each of said first pair of attachment arms having an inverted U-shape configuration with the ends of the legs of the U-shape being secured to said base, the crossportion of each U-shaped attachment arm having an outwardly extending pocket for receiving a tool therein to flex the arm outwardly enabling facile removal of the adapter from the module, said base having a transverse groove and said second pair of attachment arms being secured in said groove to prevent such attachment arms from rotating in a horizontal plane on the base, said base also having a pair of longitudinal grooves and said pair of prong connectors being secured respectively in said longitudinal grooves to prevent them from rotating in a horizontal plane on the base.

* * * * *